US005815862A

United States Patent [19]

Rygiel

[11] Patent Number: 5,815,862

[45] Date of Patent: Oct. 6, 1998

[54] PORTABLE ORTHOPEDIC BED

[76] Inventor: Witold W. Rygiel, 8085 Jackpine Road, Vernon, B.C., Canada, V1B 3M9

[21] Appl. No.: 835,879

[22] Filed: Apr. 8, 1997

[51] Int. Cl.[6] ..... A47C 27/10

[52] U.S. Cl. ..... 5/632; 5/710; 5/722; 5/733; 5/734

[58] Field of Search ..... 5/632, 633, 634, 5/710, 713, 722, 731, 733, 734, 900.5, 903

[56] References Cited

U.S. PATENT DOCUMENTS

| | | | |
|---|---|---|---|
| 3,680,917 | 8/1972 | Harris | 5/633 X |
| 4,171,549 | 10/1979 | Morrell et al. | 5/632 |
| 4,791,687 | 12/1988 | Iwase | 5/731 X |
| 5,448,790 | 9/1995 | Saro et al. | 5/632 X |
| 5,528,783 | 6/1996 | Kunz | 5/634 |

*Primary Examiner*—Michael F. Trettel
*Attorney, Agent, or Firm*—Antony C. Edwards

[57] ABSTRACT

A portable orthopedic bed for the correct orthopedic support of a patient has a longitudinally adjacent array of laterally extending air inflatable chambers wherein the array has a first set of chambers and a second set of chambers. A set of chambers has a lower back supporting chamber adjacent a midpoint between the first and second sets of chambers, the lower back chamber also adjacent an upper back supporting chamber on an opposed side of the lower back supporting chamber from the midpoint, an upper foundation chamber adjacent the upper back supporting chamber on an opposed side of the upper back supporting chamber opposed to the lower back supporting chamber, wherein the upper foundation chamber is generally triangular in longitudinal cross section to thereby provide a buttressing foundation for the upper back supporting chamber. A lumbar supporting chamber has an independently inflatable chamber from the lower back supporting chamber and disposed generally adjacent the lower back supporting chamber beneath the lumbar area of a patient lying on the portable orthopedic bed with a coccyx of the patient located generally at the midpoint. A set of chambers has a thigh supporting chamber adjacent the midpoint and extending between the midpoint and an adjacent lower foundation chamber on an opposing side of the thigh supporting chamber to the midpoint and a lower leg elevating chamber overlaying the lower foundation chamber.

5 Claims, 3 Drawing Sheets

PORTABLE ORTHOPEDIC BED

FIELD OF THE INVENTION

This invention relates to the field of inflatable devices and in particular to the field of inflatable bed-like devices which simulate articulated hospital beds.

BACKGROUND OF THE INVENTION

When a patient is in hospital, the adjustability of a hospital bed can help a great deal in getting the patient into a comfortable position. Further, a lower limb injury may call for elevation of the feet or knees for drainage, a breathing problem may be relieved best by head and upper torso elevation, or a lower back problem may require lumbar or thoracic support or elevation. Once the patient goes home, however, this adjustability is not inexpensively available.

Thus it is an object of the present invention to provide a portable orthopedic bed as a solution to this problem, and in particular to provide an inflatable mattress comprised of several anatomically placed separate airtight compartments, including a separate lumbar support compartment within a lower torso supporting compartment, where the configuration of the mattress can be altered by inflating or deflating any specific combination of compartments to achieve the support in the exact parts of the body needed by the patient.

Thus it is a further object to provide a cost-effective alternative to a hospital bed for homebound or adult home patients who would otherwise not have access to a hospital bed, or to provide a support solution for someone who has a temporary injury to give them orthopedically correct comfort while they are recuperating.

Applicant is aware of three efforts in the prior art in the field of inflatable devices, namely, U.S. Pat. No. 5,311,625 which issued to Barker et al on May 17, 1994, for a portable integrated, universally adjustable position control system, U.S. Pat. No. 4,941,221 which issued to Kanzler on Jul. 17, 1990, for a body supporting apparatus, and U.S. Pat. No. 4,639,960 which issued to Quillen et al for a recliner for medical convalescence.

Applicant notes that the Barker device is a complex, heavy device incorporating metal framing of doubtful portability having no lumbar support, no adequate leg elevation means, no heating element means, and no lateral contour conformability so as to correspond to the shape of a human body, as provided in the present invention.

Applicant notes that the Kanzler device is apparently designed for bedridden patients, the device being very complex and including means for moving the patient from a supine to a reclining position, as well as from side to side. What is not taught is adequate lower leg elevation, lumbar support, heating pad means, nor portability as in the device of the present invention.

Applicant notes that the Quillen recliner which is a portable recliner for supporting a person in a supine position, adapted to be positioned on a bed, discloses a plurality of individual wedge shaped air inflatable cushions where one of the wedge shaped cushions extends between the tailbone or coccyx and the top of the head of a user, and a second substantially triangular leg and foot support extending from the back and head support for elevation of the knee or popliteal fossa, where the supports are comprised of vertical stacks of interconnected air inflatable cushions. What is not taught is elevating the lower legs once the popliteal fossa is elevated, nor is adequate elevation of the thighs disclosed, nor lumbar support disclosed, nor heating pad means.

Further, the complexity of construction suggests a somewhat heavier weight than the simple construction of the present invention and also a bulky deflated volume which may defeat efforts to roll the deflated device into a small package so as to fit into, for example, a suitcase as in the present invention.

SUMMARY OF THE INVENTION

The portable orthopedic bed of the present invention simulates articulated hospital-like beds and exhibits a versatility which will assist in a large spectrum of medical conditions common particularly in the older age group, namely:

(a) conditions requiring elevation of the upper body due to chronic obstructive pulmonary diseases, circulatory problems, injuries, etc;

(b) lower back pain requiring a typical resting position of flexed hip and knee joints and lumbar support;

(c) conditions of peripheral circulatory insufficiency, varicose veins, obstructive arterial disease, injuries etc. requiring elevation of lower legs and/or feet so that the lower legs may be elevated to a substantially horizontal position for medical conditions requiring drainage of the lower legs.

The portable orthopedic bed of the present invention, due to its light weight, approximately 10 pounds, in a preferred embodiment, its portability, its simple operation, and its wide range of applications represents an alternative to heavy, stationary, and expensive hospital beds. Its portability, in that it can be rolled into a small package for storage or carrying, makes it useful to people with the above medical problems travelling in motor homes, trailers, campers, or spending their vacations where the bed may be easily installed.

In summary, the portable orthopedic bed of the present invention for the correct orthopedic support of a patient includes (a) a longitudinally adjacent array of laterally extending air inflatable chambers wherein the array has a first set of chambers and an second set of chambers, (b) the second set of chambers has a lower back supporting chamber adjacent a midpoint between the first and the second sets of chambers, the lower back chamber also adjacent an upper back supporting chamber on an opposed side of the lower back supporting chamber from the midpoint, an upper foundation chamber adjacent the upper back supporting chamber on an opposed side of the upper back supporting chamber opposed to the lower back supporting chamber, wherein the upper foundation chamber may be generally triangular in longitudinal cross section to thereby provide a buttressing foundation for the upper back supporting chamber; (c) a lumbar supporting chamber, independently inflatable from the lower back supporting chamber and disposed generally adjacent the lower back supporting chamber beneath the lumbar area of a patient lying on the portable orthopedic bed when the patient coccyx is located generally at the midpoint; (d) the first set of chambers includes a thigh supporting chamber adjacent the midpoint and extending between the midpoint and an adjacent lower foundation chamber on an opposing side of the thigh supporting chamber to the midpoint; and (e) a lower leg elevating chamber overlaying the lower foundation chamber.

Advantageously, the first set of chambers is pressurizable independently of the second set of chambers, and the second set of chambers is cooperatively pressurizable.

DETAILED DESCRIPTION OF THE PREFERRED EMBODIMENT

The portable orthopedic bed is an inflatable flexible mattress composed of three independently inflated air-tight compartments providing desirable body positioning required by medical indications. It serves as a substitute of a regular hospital adjustable bed for a multitude of pathological conditions, as well as a resting accessory.

When inflated the portable orthopedic bed forms a contoured mattress maintaining a position of elevation of the upper body and/or legs to a desirable degree of height and/or hardness.

The portable orthopedic bed of the present invention may be made of heavy gauge plastic material and may form a rectangular mattress having the following dimensions: 72 inches long, 30–40 inches wide, and 12 inches high (when fully inflated). It is composed, in longitudinal cross section, of six triangular generally wedge-shaped chambers and one cylindrical chamber. These chambers may be inflated to a desirable fullness or hardness according to needs, by mouth, hand, or foot pump or by an electrical pump such as may be plugged into a cigarette lighter or other power source. In a further embodiment these chambers may be connected to a compressor activated by remote control, or may be inflated by a pump to present or adjustable settings according to a programmable controller or like automotive inflation means. Thus, when a comfortable setting is reached, the exact inflation pressure for each compartment could be saved in memory and instantly repeated later after a setting change. Thus, one setting for lying on one's back could be made differently for a side position setting.

The external surface of the mattress may be covered by soft, pleasant to touch, fabrics of attractive colours appealing to the aesthetic needs.

The dimensions of the bed may be of two or three different sizes to accommodate all types of occupants including a pediatric unit.

In a preferred embodiment an electrical heating pad may be placed in the lumbar area in proximity or mounted to the lumbar support chamber, specifically for people with chronic lower back pain.

Figure 1:
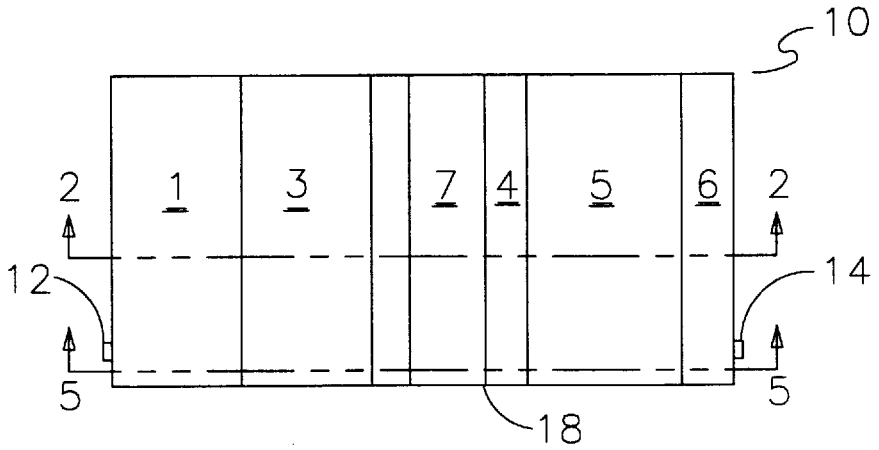
FIG. 1 is, in plan view, the portable orthopedic bed of the present invention.

Referring now the figures, FIG. 1 illustrates in plan view the parallel lateral arrangement of inflatable supporting chambers 1–7. The chambers are arranged as a longitudinally extending laterally parallel adjacent array. The interrelationship between the chambers provides the correct orthopedic support of the present portable orthopedic bed, generally indicated by the numeral 10.

Figure 3:
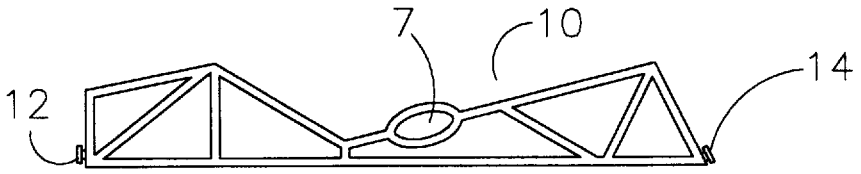
FIG. 3 is, the cross-sectional view of FIG. 2 with the lumbar support chamber inflated.
Figure 5:
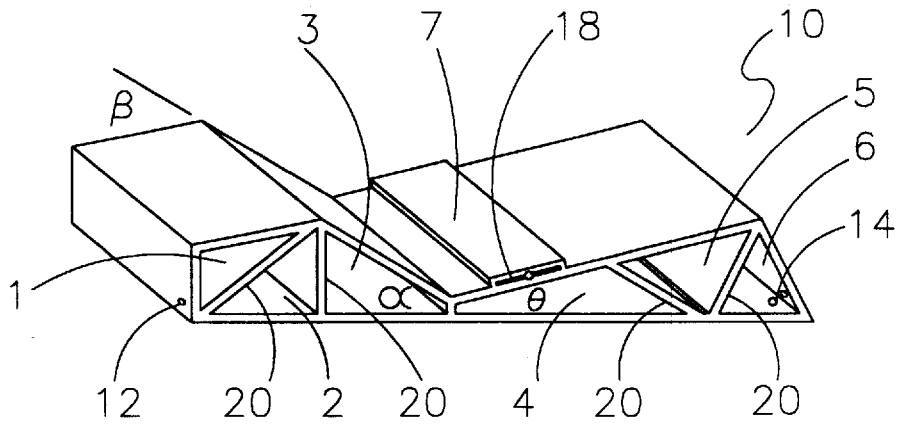
FIG. 5 is, a cross-sectional view along line 5—5 in FIG. 1.
Figure 6:
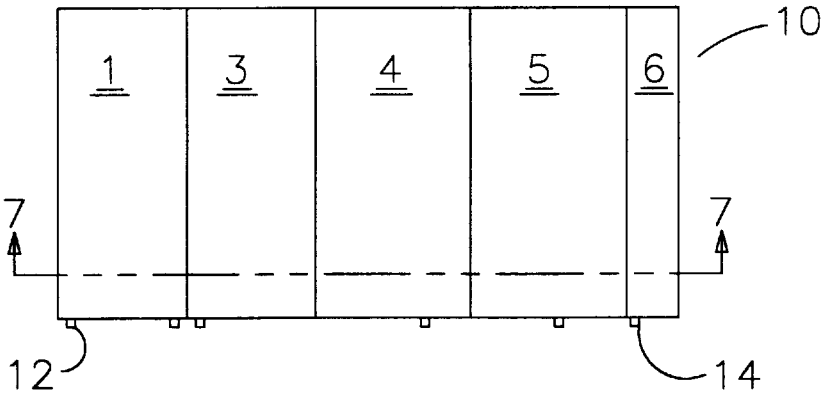
FIGS. 6–9 are views corresponding to FIGS. 1–4 in an alternative embodiment of the portable orthopedic bed of the present invention.

In a preferred embodiment, chambers 1–3 are cooperatively interconnected, so as to be inflatable and pneumatically adjustable from a single pneumatic valve 12, such as seen in FIGS. 3 and 5 at the distal leg end of bed 10. Similarly, chambers 4–6 are cooperatively interconnected so as to inflatable and adjustable for pneumatic volume and pressure by means of a single pneumatic valve 14, which, as seen in FIGS. 1, 3 and 5, may be at the distal head end of bed 10. In an alternative embodiment, such as illustrated in FIGS. 6–9, each chamber may have its own valve for inflation or deflation of the corresponding chamber. Of course, the illustrated placement of the valves are by way of example and not intended to be limiting, so long as the legs of a patient 16 may be selectively elevated independently of selective elevation of the torso and head, and independently of selective lumbar support by chamber 7, pneumatically adjustable via valve 18.

Figure 2:
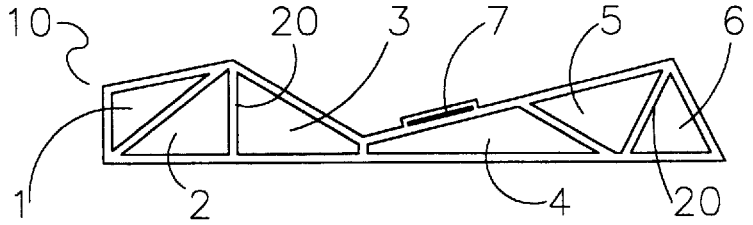
FIG. 2 is, a cross-sectional view along line 2—2 in FIG. 1.
Figure 4:
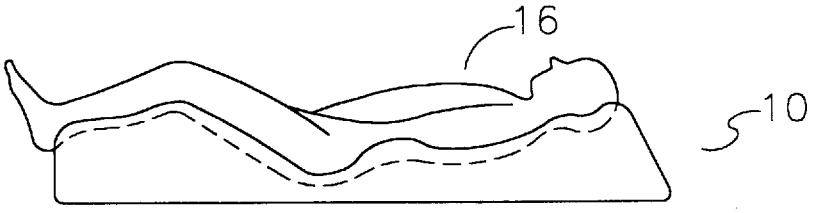
FIG. 4 is, in side elevation view, the portable orthopedic bed of the present invention with a patient lying thereon.

FIGS. 2–4 illustrate how a back and head supporting structure comprised of interconnected chambers 4, 5, and 6, may be inflated to support the lower back, torso, neck and head of patient 16, and, if required, the lumbar area by inflating chamber 7.

Figure 8:
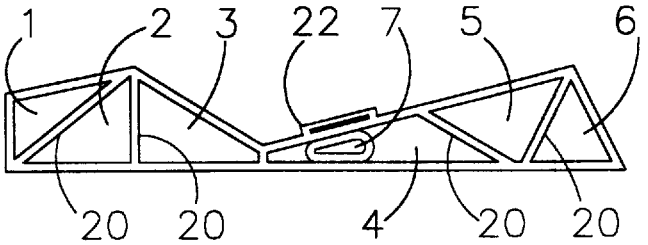
Figure 9:
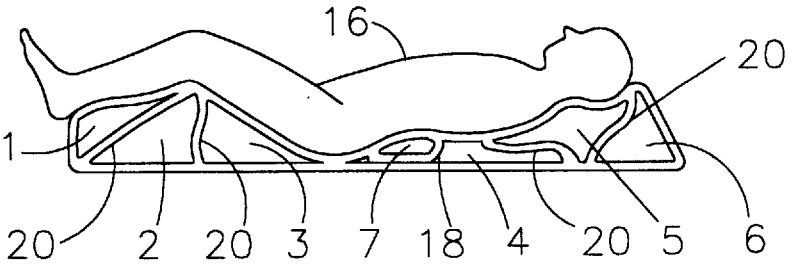

The pneumatic cooperation between chambers 4–6 allows for a first pressure setting to support the lower back, torso, neck and head while allowing a separate pressure setting to support specifically the lumbar region via chamber 7. In an alternative embodiment, placing chamber 7 may be placed within chamber 4 as depicted in FIGS. 7–9.

The leg supporting structure is comprised of chambers 1, 2, and 3, where chambers 2 and 3 are interconnected compartments which may be inflated to support not only the popliteal fossa, but also to provide correct support for the thighs, whereas illustrated in FIGS. 2–4, in an average embodiment, where the length between the coccyx and the popliteal fossa is 18 inches, the hypotenuse of the triangle formed by the cross section of chamber 3 is approximately 18 inches long. In the alternate embodiment of FIGS. 6–9, chambers 1–3 are separate, independently inflatable chambers so that chamber 3 may be inflated to a pressure which is different from that of chamber 2 so as to softly or firmly support the back of the thigh. Chamber 2 may be firmly inflated to provide the supporting structure against which chamber 3 rests. Chamber 2 also provides a supporting structure against which chamber 1 may be inflated if it is desirable to elevate the feet and lower legs so as to apply correct drainage, that is so as to elevate the feet so that the lower legs are substantially horizontal, as illustrated in FIGS. 4 and 5. In the preferred embodiment, where chambers 1–3 are interconnected, the effect of selective elevation for correct drawings may be attained by equal pressurization of chambers 1–3.

The upper outer surface material of chambers 1, 3, 4, and 5 is preferably of durable, flexible material, in a preferred embodiment having slightly resilient qualities so as to allow for pneumatic support while providing body contouring to alleviate pressure points. The upper outer surface material of chambers 1, 3, 4 and 5 may be, but does not necessarily have to be, the same material of the side surfaces are formed. Membranes 20, which form the internal barriers between chambers 1, 2, and 3, and between chambers 4, 5, and 6, may be of different material than either the upper surface or sides, so long as flexible and durable. Pneumatic cooperation between chambers 1–3 and between chambers 4–6 may be by apertures or the like in membranes 20.

Figure 7:
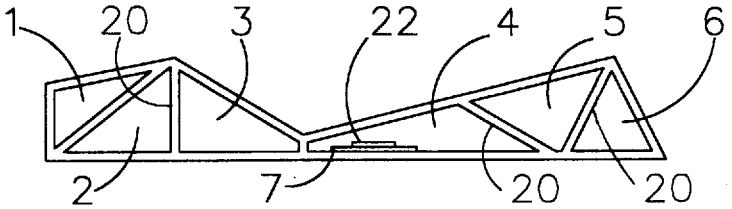

In a further embodiment, heating pad 22 may be incorporated, for example, mounted internally as illustrated in FIG. 7, so that heating pad 22 may be brought into heating engagement with the lower back of patient 16, for example, by inflating chamber 7, or heating pad 22 may be mounted on or beneath the upper surface of any of chambers 1, 3, 4, and 5.

The upper body support is composed of three interconnected chambers 4, 5 and 6, acting as one independently inflated cushion of triangular shape. When fully inflated it brings the upper body and the head to a comfortable elevation θ of about 22 degrees inclination, which is the most frequently used position for many medical conditions previously mentioned in summary of the invention.

The lower body support is similarly composed of three interconnected chambers 1, 2 and 3 which when fully inflated elevate the legs to a resting position bringing the thighs to an angulation α of about 33 degrees at the hip joints, with the upper body horizontally placed, and to about 50–55 degrees when the upper body is elevated. The angulation β between the lower and the upper legs of about 35 degrees is achieved by the shape of the various chambers 1, 2 and 3. This combined angulation of hip and knee joints is the most desirable resting position commonly used by the orthopedic surgeons for low back pain caused by arthritic changes in the sacro-iliac joints, or for sciatic nerve symptoms in intervertebral disc herniation etc.

The independently inflated optional lumbar support of chamber 7 is a frequently helpful addition to the resting positioning of the body in low back pain condition and it can be inflated to a desirable degree by the individual user.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A portable orthopedic bed for the correct orthopedic support of a patient comprising:

(a) a longitudinally adjacent array of laterally extending air inflatable chambers wherein the array comprises a first set of chambers and a second set of chambers;

(b) said second set of chambers comprising a lower back supporting chamber adjacent a midpoint between said first and said second sets of chambers, said lower back chamber also adjacent an upper back supporting chamber on an opposed side of said lower back supporting chamber from said midpoint, an upper foundation chamber adjacent said upper back supporting chamber on an opposed side of said upper back supporting chamber opposed to said lower back supporting chamber, wherein said upper foundation chamber is generally triangular in longitudinal cross section to thereby provide a buttressing foundation for said upper back supporting chamber;

(c) a lumbar supporting chamber, independently inflatable from said lower back supporting chamber and disposed generally adjacent said lower back supporting chamber beneath the lumbar area of a patient lying on said portable orthopedic bed with a coccyx of said patient located generally at said midpoint;

(d) said first set of chambers comprising a thigh supporting chamber adjacent said midpoint and extending between said midpoint and an adjacent lower foundation chamber on an opposing side of said thigh supporting chamber to said midpoint;

(e) a lower leg elevating chamber overlaying said lower foundation chamber.

2. The bed of claim 1 wherein said first set of chambers is cooperatively pressurizable independently of said second set of chambers, and said second set of chambers is cooperatively pressurizable.

3. The bed of claim 1 wherein said first set of chambers define a first upper inclined surface and second set of chambers define second upper surface, said first and second upper inclined surfaces forming a V-shaped patient supporting surface having a vertex at said midpoint.

4. The bed of claim 3 wherein said first upper inclined surface defines a first angle of approximately 33 degrees with a generally horizontal lower surface of said first and second sets of chambers when said second upper surface is in a generally horizontal orientation, said first upper inclined surface corresponding to a thigh area of a patient lying on said bed, and wherein said first angle is approximately between 50 and 55 degrees when said second upper surface is elevated in an elevated orientation of approximately 22 degrees relative to said generally horizontal lower surface, said second upper surface selectively inclinable between said generally horizontal orientation and said elevated orientation, and said first upper inclined surface selectively inclinable so as to selectively adjust said first angle between approximately at least 30 and 55 degrees.

5. The bed of claim 4 wherein said first set of chambers further defines a lower-leg supporting surface for supporting a lower portion below the knees of said patient, wherein said lower-leg supporting surface is reclinable out of a plane generally containing said first upper inclined surface so as to define a second angle therewith, wherein said second angle is selectively reclinable to approximately 35 degrees.

* * * * *